United States Patent [19]

Evans et al.

[11] Patent Number: 4,527,481

[45] Date of Patent: Jul. 9, 1985

[54] IMPACT SENSITIVE HIGH TEMPERATURE DETONATOR

[75] Inventors: John H. Evans, Lansdale; Kenneth T. Sabotta, West Chester, both of Pa.

[73] Assignee: ICI Americas Inc., Wilmington, Del.

[21] Appl. No.: 483,134

[22] Filed: Apr. 8, 1983

[51] Int. Cl.[3] ..... F42C 19/08

[52] U.S. Cl. ..... 102/204

[58] Field of Search ..... 102/204, 275.6, 275.11, 102/318, 322, 470

[56] References Cited

U.S. PATENT DOCUMENTS

| | | | |
|---|---|---|---|
| 2,857,847 | 10/1958 | Seavey et al. | 102/204 |
| 3,186,341 | 6/1965 | Bjorklund et al. | 102/204 |
| 3,353,488 | 11/1967 | Stadler et al. | 102/204 |
| 3,618,523 | 11/1971 | Stresau et al. | 102/204 |

FOREIGN PATENT DOCUMENTS

| | | |
|---|---|---|
| 56190 | 7/1982 | European Pat. Off. . |
| 1122374 | 8/1968 | United Kingdom . |
| 1180129 | 2/1970 | United Kingdom . |
| 1314203 | 4/1973 | United Kingdom . |

*Primary Examiner*—Charles T. Jordan

*Attorney, Agent, or Firm*—John M. Sheehan

[57] ABSTRACT

An impact sensitive high temperature detonator is disclosed. The detonator comprises an initiator charge of lead azide next to a thin casing wall at the input end, and a mass of finely divided refractory material adjacent to the initiator charge. The detonator can be initiated by a rounded firing pin, which indents the casing wall without puncturing it. In the event of misfire, the casing will remain intact, which facilitates safe removal of the detonator.

12 Claims, 3 Drawing Figures

IMPACT SENSITIVE HIGH TEMPERATURE DETONATOR

BACKGROUND OF THE INVENTION

1. Field of the Invention

This invention relates to detonators and particularly to detonators which are initiated by a firing pin. More particularly, this invention relates to impact sensitive high temperature detonators.

2. Description of the Prior Art

Detonators have been used for years to initiate explosive charges in oil wells. Both percussion detonators and electrically initiated detonators have been used for this purpose. U.S. Pat. Nos. 2,214,226 to English and 3,066,733 to Brandon illustrate the use of percussion and electrical detonators, respectively, in oil wells.

The oil well drilling industry is in need of a detonator which can withstand high temperatures, which can be initiated at subterranean depths, and which can be safely removed in the event of misfire.

High temperatures may be encountered in use. Temperatures encountered in oil wells may be much higher than those encountered at the earth's surface. The high temperature requirement for detonators used in the oil well drilling industry is satisfied if the detonators are able to withstand temperatures of 400° F. (204° C.) for 72 hours.

For safety reasons it is highly desirable that a percussion detonator be capable of initiation without puncturing the front end of the casing (i.e., the end which is struck by the firing pin). A detonator which has this capability is characterized herein as "impact sensitive". Other detonators, in contrast, are "stab sensitive"; that is, they can be initiated by a pointed firing pin which punctures the casing, but not by a blunt or rounded firing pin which does not puncture the casing. It is important not to puncture the casing because, in the event of misfire, it is desirable to remove the detonator without danger of firing.

Although lead azide is generally regarded as a highly sensitive primary explosive, attempts at providing an impact sensitive detonator having lead azide alone as the initiator charge were unsuccessful. Detonators of this type could be fired by a pointed firing pin which punctured the casing, but could not be fired by a rounded or blunt firing pin which did not puncture the casing.

U.S. Pat. No. 3,618,523 to Hiquera et al. discloses a stab-electric detonator comprising a priming charge of NOL 130 at the input end, followed by charges of lead azide and RDX. This detonator may be initiated by a stab electrode which pierces a diaphragm at the input end.

Kirk-Othmer "Encyclopedia of Chemical Technology", 3rd ed., vol. 9, page 570, published by John Wiley and Sons, New York, 1980, discloses that a readily ignitable material such as lead styphnate or NOL 130 is often used as a cover charge to ensure initiation of detonators containing lead azide as the primary explosive.

Kirk-Othmer, cited supra, page 568, discloses that some primary explosives are used in nondetonating stab and percussion primers, and that additional compounds and abrasives are sometimes incorporated to increase mechanical action, citing NOL 130 as a typical composition.

Ellern, H., "Modern Pyrotechnics", Chemical Publishing Co , New York, 1961, page 272, discloses an "old-type percussion primer" formula consisting of potassium chlorate, antimony sulfide, cuprous thiocyanate, and ground glass.

Although detonators have been used for years to ignite explosive charges in oil wells, no fully satisfactory percussion detonator meeting the requirements of safety and high temperature stability explained above has been developed prior to the present invention.

SUMMARY OF THE INVENTION

According to this invention there is provided a detonator which comprises (a) a cylindrical casing which is closed at one end and open at the other end, the closed end having a striking surface capable of deformation without rupture when struck by a rounded firing pin, (b) a primary explosive charge adjacent to the closed end of the casing, (c) a mass of finely divided refractory material adjacent to the primary explosive charge, and (d) an impact member extending transversely across the casing and forming with the casing a confined space for the primary explosive charge and the refractory material.

The detonator in its preferred embodiments also contains an output charge of high or secondary explosive between the impact member and the open end of the casing.

Preferred detonators according to this invention use high temperature stable explosive materials. Lead azide is the preferred primary explosive and HNS is the preferred output charge material. These preferred detonators may be characterized as impact sensitive high temperature detonators.

DESCRIPTION OF THE PREFERRED EMBODIMENTS

Figure 1:
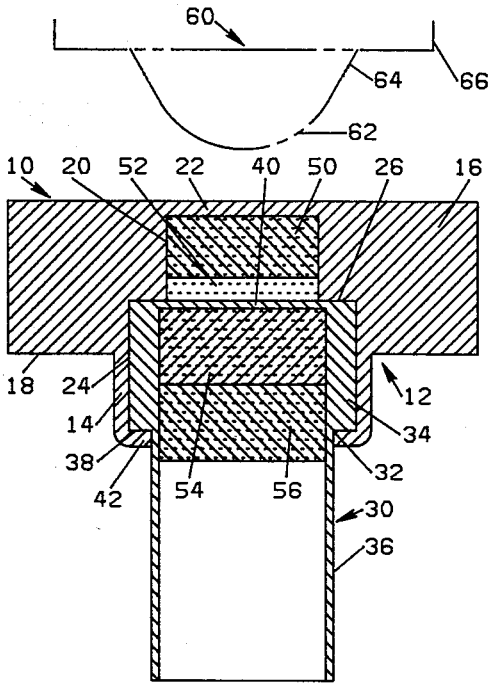
FIG. 1 is a sectional view of a detonator according to a first embodiment of this invention before firing.

The preferred detonators of this invention comprise: (a) a cylindrical casing which is closed at one end and open at the other end, the closed end having a thin metallic striking surface which is capable of deformation without rupture when struck by a rounded firing pin; (b) a primary explosive or initiator charge adjacent to the closed end of the casing; (c) a mass of finely divided refractory material adjacent to the primary explosive charge; (d) a metallic impact member or anvil; (e) an additional quantity of primary explosive on the output side of the anvil; and (f) an output charge of secondary or high explosive material. The materials and elements contained within the casing (i.e., items (b) through (f)) have been listed in the order in which they are arranged in the preferred detonators, beginning at the closed or input end of the casing and progressing toward the open or output end of the casing.

The casing is preferably a metallic casing. Use of an all metal casing is essential when high temperature stability is desired, and is preferred in all cases because all-metal casings are stronger than those made of plastic material. Preferred metals are those which are strong but nevertheless ductile and which do not chemically interact with the explosive materials. Suitable metals include aluminum alloys and stainless steel. Alternatively but not preferably, the casing may be made of a plastic material. However, a metal striking surface, which is that portion of the closed end of the casing which is struck by the firing pin in order to initiate the detonator, is highly preferred even when the rest of the casing is made of plastic. The striking surface must be thin and ductile so that it may be deformed without rupture when struck by a rounded firing pin. Ductile alloys possess the required ductility to a greater degree than plastics.

The casing is preferably made in two parts, one inside the other, as will be explained subsequently with reference to the drawings.

The initiator charge consists of a primary explosive material. Lead azide in finely divided form is the preferred primary explosive material. Alternatively, silver azide may be used. Other materials in general do not possess the desirable initiation characteristics of lead azide or silver azide.

It is important to place a mass of hard finely divided material next to the primary explosive charge, in order to initiate the primary explosive with a blunt or rounded firing pin which will not rupture the casing. Materials having the required hardness are in general refractory materials in finely divided form. Representative refractory materials include silicon carbide, powdered metals, aluminum oxide, sand, and ground glass. It is believed that firing causes some of the particles of lead azide or other primary explosive to be abraded as they rub against the hard refractory particles. This aids in decomposition of the lead azide. This abrasive action is promoted by the fact that the primary explosive charge and the refractory material are contained in a confined space, the volume of which is reduced when a firing pin strikes the casing.

Lead azide alone, without the refractory material adjacent to the lead azide charge, is stab sensitive but not impact sensitive; that is, it can be initiated by a pointed firing pin which pierces the casing, but not by a blunt or rounded firing pin which deforms the casing without rupturing it. Use of this hard refractory material adjacent to the primary explosive or initiator charge is an important feature of the present invention.

For safety reasons the primary explosive and the refractory material should be present as separate charges with the primary explosive nearest the input end and the refractory material next to the primary explosive. In other words, the refractory material should follow the primary explosive, not precede it or be mixed with it.

A metallic impact member or anvil extends transversely across the casing, providing a confined space which houses the initiator charge and the mass of refractory material. This anvil has sufficient thickness and mass so that it will not immediately give way when the detonator is struck by the firing pin. This causes the primary explosive material to be driven into the refractory material mass, thereby aiding in initiation. This anvil may be formed by the end wall of the inner casing member, as will be more apparent from the subsequent description with reference to the drawings.

A second charge of primary explosive, preferably lead azide, may be placed on the output side of the anvil. It is frequently more convenient to utilize two separate spaced charges of primary explosive rather than to place the entire quantity of primary explosive next to the closed end of the casing.

Preferred detonators of this invention also contain an output charge of secondary or high explosive material. The preferred output charge material is hexanitrostilbene (HNS). HNS has the output characteristics necessary to initiate further elements of an explosive train, and is stable at temperatures up to 400° F. or higher. Other suitable output charge materials having high heat stability include 2,4,8,10-tetranitro-5H-benzotriazolo[2,1-a]benzotriazol-6-ium hydroxide inner salt (TACOT), 1,3-diamino-2,4,6-trinitrobenzene (DATB), 1,3,5-triamino-2,4,6-trinitrobenzene (TATB), diaminohexanitrobiphenyl (DIPAM), and 2,6-bis(picrylamino-3,5-dinitropyridine). These materials are listed in Kirk-Othmer "Encyclopedia of Chemical Technology", 3rd ed., vol. 9, page 591, published by John Wiley and Sons, New York, 1980. Other high explosives including cyclomethylenetrinitramine (RDX) can also be used where high temperature stability is not a consideration.

The explosive and refractory materials are in finely divided form. All explosive materials are charged to the casing at high pressure, typically about 15,000 psi (approximately 1000 atmospheres). The refractory material should be charged at atmospheric pressure for safety reasons.

The detonator may include a thin disc of plastic or metallic material on the output side of the output charge, as an aid in holding the output charge in place. Polyethylene terephthalate is a suitable plastic material. However, such disc is not necessary and in fact is not preferred, since the output charge when loaded at high pressure (as is preferred) is sufficiently coherent that it will stay in place without the use of a retainer disc.

Detonators of this invention are used to initiate further elements of an explosive train. For example, a fuse cord, typically consisting of HNS surrounded by a suitable sheath, is inserted into the open end of the casing and extends to an explosive charge which is to be fired by the detonator herein.

This invention will now be described with reference to the drawings. The two illustrated embodiments differ in casing details, but are similar in the arrangement of explosive and refractory charges.

FIRST EMBODIMENT (FIGS. 1 AND 2)

Referring now to FIG. 1, the detonator of this embodiment has a two piece cylindrical metallic casing 10 which is closed at one end and open at the other end.

The body (or outer casing member) 12 of casing 10 comprises a cylindrical outer sleeve 14 and a cylindrical head 16 whose thickness is appreciable compared to its diameter. The diameter of head 16 is greater than that of sleeve 14, providing a shoulder 18 for supporting the detonator. Sleeve 14 and head 16 are concentric. Head 16 has central bore 20 which has a diameter slightly less than the inside diameter of sleeve 14. Bore 20 extends inwardly from one face of head 16 (the face to which sleeve 14 is attached) and terminates in an end wall 22, which is the central portion of head 16. Bore 20 forms a cavity for the initiator and refractory material charges. End wall 22 and head 16 are integral; the exterior surface of end wall 22 is a continuation of a surface of head 16.

End wall 22 forms a striking surface for a rounded firing pin, as will be explained with reference to FIG. 2. End wall 22 is thin and ductile so that it will be deformed but will not rupture when struck by a rounded firing pin.

Head 16 also has a counterbore 24 which is concentric with bore 20. The diameter of counterbore 24 is the same as the inside diameter of outer sleeve 14, so that the counterbore 24 is a continuation of the inner wall of sleeve 14. The depth of counterbore 24 is less than that of bore 20, so as to form a shoulder 26.

Cup or inner casing member 30 fits inside body 12. Cup 30 has a cylindrical inner sleeve 32 having a relatively thick portion 34 and a thin portion 36, forming a shoulder 38. The inside diameters of the thick and thin sleeve portions 34 and 36 respectively are the same, while the thick portion 34 has a greater exterior diameter than the thin portion 36. The outside diameter of thick portion 34 is just slightly less than the inside diameter of outer sleeve 14. An end wall 40 adjacent to thick portion 34 closes one end of sleeve 32; the other end is open. The end wall 40 abuts against the shoulder 26 of the body 12. Shoulder 26 bears any force exerted against cup 30, either in inserting cup 30 into body 12 or in loading cup 30 with explosive materials, so that such force is not transmitted to the initiator charge in bore 20. The outer portion 42 of sleeve 14 is crimped inwardly against shoulder 38 to secure cup 30 in place inside body 12.

An initiator charge 50 of a finely divided primary explosive such as lead azide is situated next to end wall 22 in bore 20. Next to the initiator charge 50 is a small mass 52 of finely divided hard refractory material. The combined depths of initiator charge 50 and refractory material mass 52 are preferably equal to the axial length of bore 20 (i.e., the distance from end wall 22 to shoulder 26), so that the initiator charge and refractory material together exactly fill the bore 20. The combined depths of initiator charge 50 and refractory material may be less than the axial length of bore 20, but may not be greater.

End wall 40 of inner casing member 30 retains the initiator charge 50 and refractory material mass 52 in place. End wall 40 also forms an impact member or anvil as will be more fully explained subsequently.

A second charge 54 of finely divided primary explosive is situated adjacent to the anvil 40 on the output side thereof. This primary explosive material is the same as that used in the initiator charge 50. The preferred primary explosive in both cases is lead azide.

It is possible to omit the second charge 54 of primary explosive material and to place the entire quantity of primary explosive material needed in the initiator charge 50. Such arrangement is feasible if the cavity formed by bore 20 is large enough to contain the entire quantity of primary explosive needed for the desired output of the detonator.

An output charge 56 of finely divided high or secondary explosive material may be placed next to the second charge 54 of primary explosive. The output charge 56 is the explosive material charge that is closest to the output end of the detonator.

A thin disc (not shown) of plastic or metal material may be placed next to charge 56 on the output side thereof if desired. Such disc is not necessary in most cases, because the output charge 56 when loaded under pressure is sufficiently coherent that no disc is needed. Furthermore, such disc may impair transmission of explosive force to the next stage of the explosive train.

The sleeve 32 preferably extends for some distance beyond the output charge 56, so that there is a free space inside the detonator adjacent to the output end thereof. This free space may receive a fuse cord (not shown) which detonates an explosive (not shown).

The output charge 56 may be omitted. When output charge 56 is omitted, it is desirable (although not necessary) to provide a booster having a charge of high or secondary explosive material. A fuse cord may extend from the booster to an explosive to be detonated, and the space between the detonator of this invention and the separate high explosive charge is preferably confined but unobstructed.

The detonator of FIG. 1 may be assembled as follows: The sleeve 14 of the body 12 is initially straight, i.e., not crimped as shown in FIG. 1. The body 12 is turned so that the sleeve 24 extends upwardly. The initiator charge 50 is then loaded under pressure, typically about 15,000 psi (approximately 1000 atmospheres). Then the refractory charge 52 is loaded on top of the initiator charge 50 at atmospheric pressure until the top surface of the refractory charge 52 is flush with shoulder 26.

The second charge 54 of primary explosive, and the output charge 56 when used, are then charged under pressure (typically about 15,000 psi or approximately 1000 atmospheres) to cup 30. Then cup 30 is then inserted into body 12 until the end wall 40 abuts shoulder 26. Finally, the outer end of sleeve 14 is crimped as shown at 42 in order to hold the cup 30 in place. Shoulder 26 bears any forces placed on cup 30 during crimping, so as to prevent accidental initiation of the initiator charge 50.

An alternative but less desirable order of assembly is as follows: Initiator charge 50 and refractory charge 52 are loaded into body 12 as above described. Then cup 30 is inserted empty into body 12 until the end wall 40 touches shoulder 26. Then the second charge 54 of primary explosive material, and the output charge 56 (when used), are loaded into cup 30. This alternative order of assembly is less convenient and slightly more hazardous than the preferred order.

To use a detonator of this invention in oil field operations, an assembly comprising a firing pin 60, a detonator, a fuse cord, and explosive charge to be initiated by the detonator, and optionally a supporting fixture for these components, may be prepared above ground at the oil field site and lowered to the desired depth in an oil well casing in a conventional manner.

Figure 2:
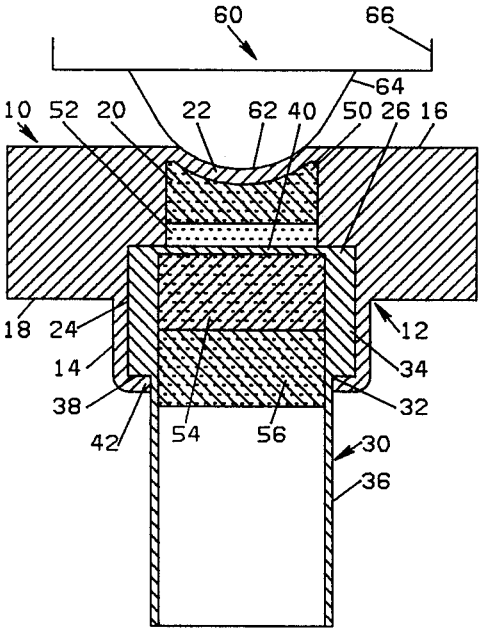
FIG. 2 is a sectional view of a detonator according to the first embodiment of this invention which has been struck by a rounded firing pin without firing.

The detonator is initiated by means of a blunt or rounded firing pin 60, shown diagramatically in FIG. 2. This firing pin as shown has a hemispherical striking surface 62 and a conical shank 64 which is joined at its larger end to a cylindrical head 66 which moves forward axially when triggered. Any suitable apparatus which enables the firing pin to deliver a blow of desired force at a desired location on striker surface 22, as for example the gun shown in U.S. Pat. No. 3,662,452 to Stonestrom, may be utilized. The firing pin is supported in position above the striker surface 22, as shown by the phantom lines in FIG. 1, prior to initiation.

When the firing pin 60 delivers its blow, the striking surface 22 is indented without being punctured as shown in FIG. 2. This temporarily compresses the volume of the chamber housing the primary explosive charge 50 and the associated refractory charge 52. As particles of the primary explosive charge 50 rub against refractory particles, these particles of primary explosive are caused to decompose, which quickly causes decomposition of the entire quantity of primary explosive charge 50. The anvil 40 is then propelled into the additional quantity of primary explosive 54, which in turn sets off the output charge 56. The resulting shock wave is communicated to the fuse cord, which in turn sets off the principal explosive charge.

In the event of misfire, the detonator remains intact with the striking surface 22 dimpled inwardly but unbroken, as shown in FIG. 2.

The detonator of FIGS. 1 and 2 may be of any desired size. Such detonators are ordinarily small in size. A representative detonator may have a head 16 with a diameter of 0.625 inch and a thickness of 0.20 inch, with a striking surface 22 which is 0.025 inch thick. The inner casing member 30 may have a length of 0.50 inch, an inside diameter of 0.222 inch, and an outside diameter (in the thinner portion 36) of 0.25 inch. The bore 20 may have a diameter of 0.19 inch and an axial length (measured from end wall 22 to shoulder 26) of 0.10 inch. These dimensions are merely illustrative; other dimensions may be used.

Detonators of this invention may be used in mining, quarrying, blasting, or for other purposes where detonators and primers are presently used, as well as in oil field operations. However, detonators of this invention are most useful in situations where high temperature stability is required, notably in oil wells.

SECOND EMBODIMENT (FIG. 3)

Figure 3:
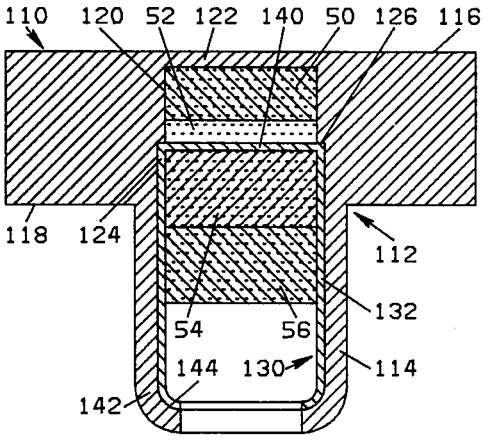
FIG. 3 is a sectional view of a detonator according to a second embodiment of this invention before firing.

The embodiment of FIG. 3 is similar to the embodiment of FIG. 1 except for some differences in casing structure. The explosive materials, the refractory material, and the arrangement of these materials are the same as in the embodiment of FIG. 1.

Referring now to FIG. 3, the detonator according to this embodiment of the invention has a two piece cylindrical metallic casing 110 which is closed at one end and open at the other end.

The body 112 of casing 110 comprises a cylindrical outer sleeve 114 and a cylindrical head 116 which has a thickness relatively large compared to its diameter. The diameter of head 116 is greater than that of sleeve 114, providing a shoulder 118 for supporting the detonator. Head 116 and sleeve 114 are concentric.

Head 116 has a central bore 120 of circular cross-section. Bore 120 terminates in a thin end wall 122 which serves as a striking surface for a blunt or rounded firing pin.

Head 116 also has a counterbore 124, which is concentric with bore 120 and of slightly larger diameter and somewhat less depth. The diameter of counterbore 124 may be the same as the inside diameter of outer sleeve 114. This provides a shoulder 126. The difference between bore and counterbore diameters is less than in the embodiment of FIG. 1.

Cup 130 fits inside body 112. Cup 130 comprises a cylindrical inner sleeve 132 and an end wall 140 at one end of the sleeve 132. The other end of the sleeve 132 is open. The outside diameter of inner sleeve 132 is slightly less than the inside diameter of outer sleeve 114 to insure easy assembly. The end wall 140 rests against shoulder 126 in the assembled detonator.

Sleeves 114 and 132 extend approximately the same distance from the plane of shoulder 118. The open ends of sleeves 114 and 132 are crimped inwardly at 142, 144 respectively as shown. Sleeves 114 and 132 are unbent cylinders prior to assembly of the detonator.

The detonator of FIG. 3 contains an initiator charge 50 of primary explosive material, preferably lead azide, adjacent to the end wall 122. Next to the primary explosive charge 50 is a small mass of hard refractory material 52.

The end wall 140 of inner casing member 64 serves as an anvil similar to end wall 40 in FIG. 1.

A second charge of primary explosive material 54, and an output charge 56, are disposed on the output side of end wall 140. A thin retainer disc (not shown) on the output side of charge 56 is optional and is not ordinarily needed, since the output charge 56 is usually coherent enough to stay in place without such disc. The space between output charge 56 and the end of sleeve 132 is open.

The inner casing member 130 can be replaced by a transversely extending metal disc interposed between the refractory material mass 52 and the second charge 54 of primary explosive. This disc then becomes the impact member or anvil held in place against shoulder 118 by conventional means such as a metal washer, soldering, or adhesive. Because of the small size of the detonator, the arrangement shown in FIG. 3 is preferable to the alternatives.

The output charge 56 and the second charge 54 of primary explosive can be omitted. As in the embodiment of FIG. 1, it is desirable to provide a separate booster containing a secondary or high explosive when output charge 56 is omitted.

The detonator of FIG. 3 is preferably assembled in the same manner as the detonator of FIG. 1.

EXAMPLES

This invention will be described in further detail with reference to specific embodiments, as set forth in the examples which follow.

EXAMPLE 1

Detonators having the casing dimensions given in Table 1 and the powered material quantities given in Table 2 were prepared. Dimensions in Table 1 are prior to crimping.

TABLE 1

Casing Dimensions

| Parameter | Dimension (inches) |
|---|---|
| Overall length | 0.625 |
| Diameter of head 16 | 0.625 |
| Thickness of head 16 | 0.200 |
| Thickness of striking surface 22 | 0.025 |
| Diameter of bore 20 | 0.190 |
| Axial length of bore 20 | 0.100 |
| Outside diameter of outer sleeve 14 | 0.350 |
| Inside diameter of inner sleeve 32 | 0.222 |

TABLE 2

Weights of Powdered Materials

| Material and Reference Numeral | Weight (mg) |
|---|---|
| Initiator charge 50: lead azide | 100 |
| Refractory 52: silicon carbide | 20 |
| Second primary explosive charge 54 | 144 |

The casing was formed of aluminum alloy 2024-T4, a heat treated aluminum alloy having a nominal composition of 3.8–4.9% Cu, 0.3–0.9% Mn, 1.2–1.8% Mg, balance essentially aluminum. The designation "2024" is an industry designation denoting nominal composition, and "T4" is an industry designation denoting the nature of the heat treatment.

The lead azide for both the initiator charge and the second charge was a finely divided powdered material of irregular particle size and shape, having a purity of at least 98.5% and containing 0.60–1.20% by weight of carboxymethyl cellulose (as the lead salt). This material is designated as "RD1333".

The silicon carbide had a fineness of "80 grit", that is, a fineness comparable to that of the abrasive material in 80 grit sandpaper.

The firing pin 60 used in the tests described in this example had an overall length of 0.215 inch, a maximum width of 0.255 inch, and a spherical radius of 0.10 inch at its forward end. This pin was mounted on cylinder 66 of a spring gun which was capable of causing the pin to strike at several predetermined energy levels.

A 100 mg charge of lead azide was pressed at a pressure of 15,000 psi into bore 20 of detonator body 12 while the body was supported in the upright position. The density of this charge was approximately 3.07 g/cc. The height of this charge was measured. Then 20 mg of 80 grit silicon carbide was charged into bore 20. A second charge of lead azide (144 mg) was pressed into cup 30 at a pressure of 15,000 psi. The cup 30 was then inserted into body 12, and the end of the outer sleeve 14 was crimped over shoulder 38 of cup 30.

Five detonators prepared as described above were tested by striking the striking surface 22 of each detonator with the firing pin described above. The firing energy was 30 inch pounds in four of these tests, 20 inch pounds in the fifth test. All five detonators fired.

EXAMPLE 2

Detonators having the casing dimensions given in Table 3 below were prepared.

TABLE 3

| Casing Dimensions | |
|---|---|
| Parameter | Dimensions (inches) |
| Overall length | 0.500 |
| Diameter of head 116 | 0.625 |
| Thickness of head 116 | 0.200 |
| Thickness of striking surface 122 | 0.025 |
| Diameter of bore 120 | 0.190 |
| Axial length of bore 120 | 0.100 |
| Outside diameter of outer sleeve 114 | 0.283 |
| Inside diameter of inner sleeve 132 | 0.190 |

The casing was formed of aluminum alloy 2024-T4.

Powdered material quantities and specifications were the same as in Example 1, except that 25 grams of silicon carbide was used.

The detonators were assembled as follows:

A 100 mg charge of lead azide was pressed at a pressure of 15,000 psi into bore 120 of detonator body 112 while the body was supported in the upright position. The density of the charge was approximately 3.07 g/cc. The height of this charge was measured. Then 25 mg of 80 grit silicon carbide was charged into bore 120. The shoulder 126 was checked to make sure that it was free of silicon carbide. Then cup 130 was inserted, and the second charge (144 mg) of lead azide was pressed into the cup at a pressure of 15,000 psi. The ends 142, 144 of sleeves 114, 132 respectively were then crimped inwardly 90° as shown in FIG. 3.

Two detonators prepared as described above were heat soaked at 400° F. for 30 minutes and then allowed to cool. Each of the tests described below included one of these heat soaked detonators.

Sixteen detonators prepared as described above were tested by striking the striking surface 122 of each detonator with a firing pin as described in Example 1 at an energy level of 30 inch pounds. All 16 detonators fired.

Eight additional detonators prepared as described above were initiated in the same way except that the firing pin energy level was 20 inch pounds. All eight detonators fired.

COMPARATIVE EXAMPLE A

A comparison detonator, similar to those described in Example 2 except that the entire bore 120 was filled with lead azide (approximately 125 mg), was prepared. No silicon carbide was charged to this detonator.

An attempt to initiate this detonator with a firing pin as above described at 30 inch pounds was unsuccessful. The central portion 122 of head 116 was dimpled inwardly as shown in FIG. 2, but was not broken. This detonator was then struck by the firing pin at 72 inch pounds and was fired.

Other comparison detonators, having different configurations and containing initiator charges of lead azide but no refractory material, were also prepared. These detonators were struck by a firing pin as above described. They failed to fire either at 30 inch pounds or at higher energy levels. The casings of these detonators were dimpled but remained intact.

The fact that the casings of detonators which did not fire remained unbroken shows that the casing of detonators according to the present invention would also remain intact in the event of misfire.

EXAMPLE 3

A detonator was prepared as in Example 2, except that 50 mg of RDX was charged at about 15,000 psi after the second charge of lead azide was loaded and before the ends of the sleeves were crimped. RDX and HNS have similar explosive characteristics; however, RDX does not have the heat stability of HNS. This detonator was fired with a firing pin as previously described at an energy level of 30 inch pounds. The explosive force was so great that the test apparatus was damaged.

We claim:

1. An impact sensitive detonator comprising:

(a) a cylindrical casing which is closed at one end and open at the other end, the closed end having a thin striking surface which is capable of deformation without rupture when struck at forces up to 30 inch-pounds by a rounded firing pin having a circle radius of 0.1 inch;

(b) a primary explosive charge selected from the group consisting of lead azide and silver azide packed at high pressure adjacent to the closed end of the casing;

(c) a mass of finely divided refractory material selected from the group consisting of silicon carbide, powdered metals, aluminum oxide, sand and ground glass loosely charged under atmospheric pressure adjacent to and not mixed with said primary explosive charge; and (d) an impact member extending transversely across said casing and forming with said casing a confined space for said primary explosive charge and said refractory material.

2. An impact sensitive high temperature detonator according to claim 1 in which said primary explosive charge is stable at temperatures of at least 400° F.

3. A detonator according to claim 2 in which said primary explosive is lead azide.

4. A detonator according to claim 1 in which said refractory material is silicon carbide.

5. A detonator according to claim 1 including an output charge between said impact member and the open end of said casing.

6. A detonator according to claim 5 in which said output charge is a high temperature stable material.

7. A detonator according to claim 5 in which said output charge is HNS.

8. A detonator according to claim 5 including an additional quantity of primary explosive between said impact member and said output charge.

9. A detonator according to claim 8 in which said additional quantity of primary explosive is lead azide.

10. A detonator according to claim 1 in which said casing is metallic.

11. A detonator according to claim 7 in which said casing is an aluminum alloy.

12. A detonator according to claim 10 in which said casing comprises a body and a cup inside said body, said body comprising a cylindrical sleeve open at one end and closed at the other end by a head of appreciable thickness and having a diameter greater than that of said sleeve, said head including a cavity for the aforesaid initiator charge and refractory material charge, said cup comprising a cylindrical sleeve which is open at one end and closed at the other end by an end wall, said end wall of said cup constituting the aforesaid impact member.

* * * * *